US007175035B2

(12) United States Patent
Wüster

(10) Patent No.: US 7,175,035 B2
(45) Date of Patent: Feb. 13, 2007

(54) UMBRELLA-TYPE LAUNDRY DRYING APPARATUS

(76) Inventor: Heinrich Wüster, Unterm Hohen Rain 16, Imst/Tirol (AT) A-6460

( * ) Notice: Subject to any disclaimer, the term of this patent is extended or adjusted under 35 U.S.C. 154(b) by 230 days.

(21) Appl. No.: 10/920,888

(22) Filed: Aug. 18, 2004

(65) Prior Publication Data

US 2005/0040125 A1 Feb. 24, 2005

(30) Foreign Application Priority Data

Aug. 19, 2003 (AT) ..... A 1306/03
Aug. 29, 2003 (AT) ..... A 1365/03

(51) Int. Cl.
*A47B 57/00* (2006.01)

(52) U.S. Cl. ..... 211/197; 211/119.18; 211/96

(58) Field of Classification Search ..... 211/197, 211/119.18, 119.17, 1.3, 99–102, 96, 206, 211/196, 119.01, 85.24, 172; 312/297; 135/33.2, 135/34.2, 33.6
See application file for complete search history.

(56) References Cited

U.S. PATENT DOCUMENTS 483,275 A * 9/1892 Adler ..... 211/1.3
2,616,571 A * 11/1952 Griffin ..... 211/171
2,821,309 A * 1/1958 Rizzo ..... 211/197
2,923,449 A * 2/1960 Sund ..... 223/69
3,069,021 A * 12/1962 Gray ..... 211/197
4,206,847 A * 6/1980 Brink ..... 211/1.3
4,225,048 A * 9/1980 Hildreth ..... 211/1.3
4,732,285 A * 3/1988 Wuster ..... 211/197
4,735,326 A * 4/1988 Steiner ..... 211/197
4,830,202 A * 5/1989 Steiner ..... 211/197
5,280,841 A * 1/1994 Van Deursen ..... 211/197
7,000,788 B2 * 2/2006 Wuster ..... 211/197
2004/0134870 A1 * 7/2004 Daubach et al. ..... 211/196

FOREIGN PATENT DOCUMENTS

DE 101 62 098 A1 7/2003
EP 0 214 123 A2 3/1987
EP 0 357 803 A1 3/1990

* cited by examiner

*Primary Examiner*—Jennifer E. Novosad
(74) *Attorney, Agent, or Firm*—Laurence A. Greenberg; Werner H. Stemer; Ralph E. Locher

(57) ABSTRACT

An umbrella-type laundry drying apparatus has a central upright tube carrying a spreading framework, which can be swung open via an actuating mechanism. A tubular protective sheath can be pulled over the collapsed framework and clothesline. The open-out framework has carrying arms for the clothesline, which are arranged in the form of rays of a star and are articulated on a lower sliding sleeve, and supporting arms, which are connected in an articulated manner to the carrying arms and are articulated on a upper sliding sleeve. At least the lower sliding sleeve can be displaced along the upright tube and secured in different positions on the upright tube. The actuating mechanism for spreading the framework is formed by two of the carrying arms each bearing a handle which, with the open-out framework collapsed, is covered by the protective sheath when it is pulled over the collapsed framework.

15 Claims, 2 Drawing Sheets

UMBRELLA-TYPE LAUNDRY DRYING APPARATUS

BACKGROUND OF THE INVENTION

Field of the Invention

The invention relates to an umbrella-type laundry drying apparatus of the type wherein a central upright tube bears an open-out framework for the clothesline. It is thereby possible for the framework to be swung open via an actuating mechanism. The apparatus further includes a tubular protective sheath that can be pulled over the collapsed open-out framework and clothesline. The open-out framework has carrying arms for the clothesline which are disposed in star form and are articulated on a lower sliding sleeve, and supporting arms, which are connected in an articulated manner to the carrying arms and are articulated on a upper sliding sleeve. At least the lower sliding sleeve can be displaced along the upright tube and secured in different positions on the upright tube.

In a prior art laundry drying apparatus of this type, the upright tube is anchored in a vertically oriented manner in the ground at the set-up location. When the laundry drying apparatus is not in use, the open-out framework is collapsed in the direction of the upright tube and the protective sheath, in order to protect the clothesline, is pulled over the collapsed open-out framework and clothesline hanging down therefrom. The upper sliding sleeve, which is fixed axially on the upright tube, bears the collapsed open-out framework, in the case of which the knee joints formed by the supporting arms and the approximately double-length carrying arms are straightened out and both the supporting arms and the carrying arms run essentially vertically. The tubular protective sheath, at its free end, is tied securely on the upright tube beneath the collapsed open-out framework. Its end remaining in the upright tube is connected to a weight which is retained, by the securely tied protective sheath, in the position wherein it has been drawn upward in the upright tube.

In order to prepare the laundry drying apparatus for use, first of all the ties of the protective sheath are released in order that the weight, which falls downward in the upright tube, pulls off the protective sheath, which is connected to it, from the collapsed open-out framework in the upward direction. Then, with the open-out framework exposed, a cord pull assigned to the sliding sleeves is actuated, this cord pull pulling the lower sliding sleeve along the upright tube up towards the upper sliding sleeve and swinging open the open-out framework. In this case, the cord pull, which is extended to its maximum length when the open-out framework is collapsed, is shortened to approximately a fifth of this length. At the same time, the carrying arms, which are articulated on the lower sliding sleeve and bear the clothesline, are pivoted away from the upright tube into their operating position and the knee joints, which are formed by the carrying arms together with the supporting arms are bent. The lower sliding sleeve is drawn upward into the respectively desired position with the aid of the cord pull and, in this position, is fixed on the upright tube by means of its securing mechanism. The lower sliding sleeve, which is fixed on the upright tube, then retains the open-out framework in its swung-open position.

Following use of the laundry drying apparatus, the lower sliding sleeve of the open-out framework is released, whereupon the sliding sleeve then slides downward along the upright tube and collapses the open-out framework, with the knee joints of the same being straightened out, until its carrying and supporting arms run essentially vertically. By way of the collapsing open-out framework, the cord pull assigned to the sliding sleeve is extended again to its maximum length, and the pulling-cord length drawn out of the open-out framework as it is actuated is drawn into it again. The protective sheath, for protecting the clothesline, is then pulled over the collapsed open-out framework and tied securely on the upright tube beneath the open-out framework.

The cord pull, which is provided for swinging open the open-out framework, is of relatively complex construction. It contains a section, corresponding to a block and tackle, which extends from the lower sliding sleeve to the upper sliding sleeve and wherein the pulling cord is guided back and forth a number of times. This block-and-tackle section is extended to its maximum length from the collapsing open-out framework, the pulling-cord length which is actively drawn out of the open-out framework when the cord pull is actuated being passively drawn in again. The block-and-tackle section is shortened to approximately a fifth of this length when the cord pull is actuated, by pulling on the pulling cord, in order to swing open the open-out framework. The relatively long pulling-cord length which is drawn out of the cord pull here may give rise to problems during the operation of collapsing the open-out framework if it is to be passively drawn into the block-and-tackle section again without obstructing or blocking the extending action of the block-and-tackle section and thus the automatic collapsing action of the open-out framework.

SUMMARY OF THE INVENTION

It is accordingly an object of the invention to provide an umbrella-type laundry drying apparatus, which overcomes the above-mentioned disadvantages of the heretofore-known devices and methods of this general type.

With the foregoing and other objects in view there is provided, in accordance with the invention, an umbrella-type laundry drying apparatus, comprising:

a central upright tube;

an open-out framework supported on the upright tube and being movable between a swung-open position and a collapsed position;

a substantially tubular protective sheath for covering the open-out framework in the collapsed position;

a lower sliding sleeve displaceably mounted along the upright tube and an upper sliding sleeve supported on the upright tube;

the open-out framework including carrying arms articulated to the lower sliding sleeve, clothesline supported on the carrying arms, and supporting arms articulated on the carrying arms and on the upper sliding sleeve;

an actuating mechanism for swinging open the open-out framework into the swung-open position, the actuating mechanism being formed by two of the carrying arms each bearing a handle formed to be covered by the protective sheath when the protective sheath is pulled over the open-out framework in the collapsed position thereof.

In other words, the objects are achieved, according to the invention, with a laundry drying apparatus of the type mentioned in the introduction, in which the actuating mechanism provided for swinging open (i.e., spreading) the open-out framework is formed by two carrying arms of the open-out framework, each bearing a handle which, with the open-out framework collapsed, can be covered by the protective sheath pulled over the collapsed open-out framework.

This design simplifies the production and operation of the laundry drying apparatus. A cord pull acting on the two sliding sleeves of the open-out framework may be dispensed with. This not only reduces the number of individual parts which have to be produced for the laundry drying apparatus, and the amount of assembly required in order to put the latter together, but also simplifies the use of the laundry drying apparatus. In the case of the laundry drying apparatus according to the invention, it is also possible for the open-out framework to remain swung open for a number of weeks without it being necessary during this time, as in the case of the known laundry drying apparatus provided with an open-out framework which can be swung open via a cord pull, to supply a long pulling-cord length such that the latter does not end up either with loops or knots which, during the operation of collapsing the open-out framework, could obstruct or block the extending action of the cord pull and thus the collapsing action of the open-out framework.

When the laundry drying apparatus according to the invention is set up, first of all its upright tube is anchored in a vertically oriented ground sleeve. Then the exposed open-out framework is opened out by way of two carrying arms provided with a handle. In this case, the carrying arms are pivoted away from the upright tube about their pivot axes arranged on the lower sliding sleeve, and the lower sliding sleeve is pulled upward along the upright tube. When the securing mechanism of the lower sliding sleeve latches in the desired location of the upright tube, the operation of the opening out or swinging open the open-out framework is completed.

For providing the set-up laundry drying apparatus for a relatively long period of not being used, the arresting means at the lower sliding sleeve is released and the open-out framework is allowed to collapse. The protective sheath, for protecting the clothesline, is then pulled out of the upright tube and pulled over the collapsed open-out framework. In this case, the handles arranged on the carrying arms are also covered and protected against wind, rain and soiling.

The handles may be formed on the carrying arms themselves, in an integral manner therewith. The carrying arm may be provided with individual, lateral gripping protrusions. The gripping protrusions may be distributed over the length of the carrying arm. The carrying arm may be provided with a lateral longitudinal profiling which corresponds to a handle extending over its entire length and allows the carrying arm to be gripped at any point over its length. It is possible for all the carrying arms of the open-out framework to be of identical design and each to be provided with a handle. The handles may be integrated in the profile cross section of the carrying arms.

If the carrying arms, which are provided for opening out the open-out framework, are each equipped with just one handle, then the latter preferably arranged in the top half of the carrying arm, in order to have a large, effective lever arm available for opening out the open-out framework.

It is possible for the handle to be arranged on the outside of the carrying arm and, at its top end, to be flattened in the direction of the carrying arm, in order not to obstruct the operation of the protective sheath being pulled over the collapsed open-out framework.

The handle may be designed as a movable grip loop which is extended away from the carrying arm in order to open out the open-out framework and is pressed flat on the carrying arm prior to the protective sheath being pulled over. This grip loop may be fastened on the outside of the carrying arm or on one of its side surfaces.

The handle may be designed as a handgrip which projects laterally from the carrying arm and projects into the free space which remains between the adjacent carrying arms when the open-out framework is collapsed.

The handle may be configured as a swing-out handgrip articulated on the carrying arm.

Other features which are considered as characteristic for the invention are set forth in the appended claims.

Although the invention is illustrated and described herein as embodied in an umbrella-type laundry drying apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
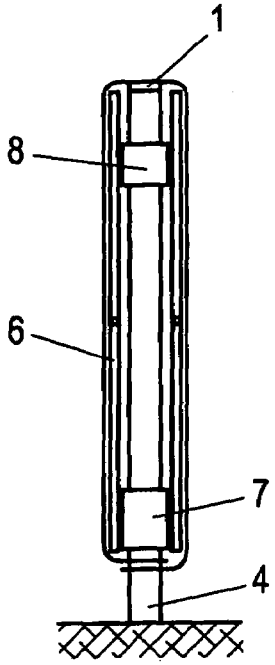
FIG. 1 is an elevational view of a laundry drying apparatus in a stowed position, with the open-out framework collapsed and the protective sheath pulled over it and tied securely.

In the drawing figures, only two of the ray-like carrying arms are illustrated for reasons of clarity. Also, the clothesline or lines have been omitted in most views.

Referring now to the figures of the drawing in detail and first, particularly, to FIG. 1 thereof, there is shown an upright tube 4 (i.e., a center pole or post) that is anchored in the ground or some other support and that extends substantially vertically. In the collapsed state shown in FIG. 1, carrying arms 6, which are articulated on a lower sliding sleeve 7, and supporting arms 5, which are articulated on the carrying arms 6 and an upper sliding sleeve 8, extend parallel to the upright tube 4. The protective sheath 1 has been pulled out of the upright tube 4 at the top and pulled over the open-out framework, or spreading framework—the latter comprising the two sliding sleeves 7 and 8, the carrying arms 6 and the supporting arms 5—and tied securely beneath the lower sliding sleeve 7.

Figure 2:
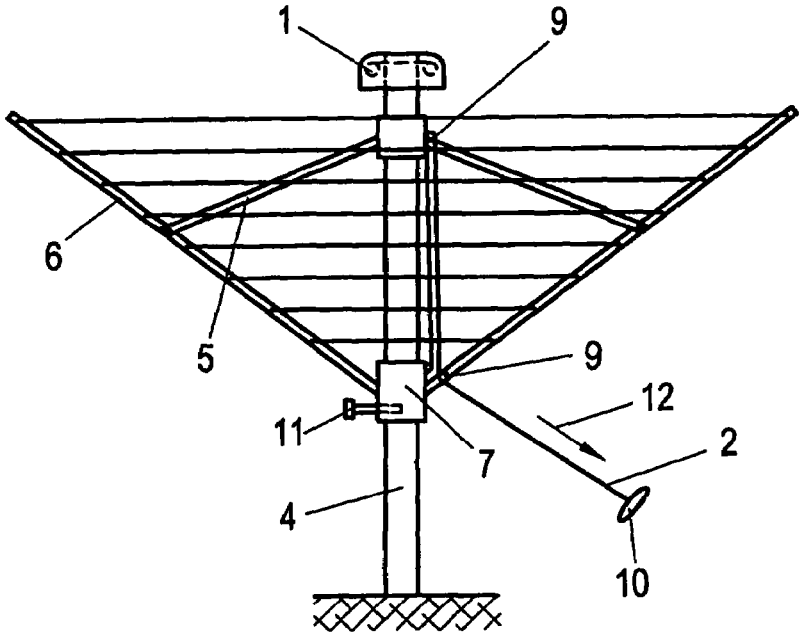
FIG. 2 is an elevational view of a laundry drying apparatus with an actuating mechanism in the form of a cord pull according to the prior art.

The illustration of the laundry drying apparatus with an actuating mechanism in the form of a cord pull in FIG. 2 shows the cord 2, which is connected to the lower sliding sleeve 7 at one end, runs over a plurality of deflecting rollers 9 and is provided with a handgrip 10 at its other end. Pulling on the cord 2 with the aid of the handgrip 10 in the direction of arrow 12 causes the lower sliding sleeve 7 to be pulled upward on the upright tube 4, and the carrying arms simultaneously pivot outward. Once the laundry drying apparatus has been opened as desired, the lower sliding sleeve 7 can be fixed at this height via a securing mechanism, for example a pin 11. The excess length of the cord 2 then has to be stowed away, in particular if the laundry drying apparatus remains in its open position for a relatively long period of time, in order to prevent the cord 2 from forming loops or becoming knotted.

Figure 3:
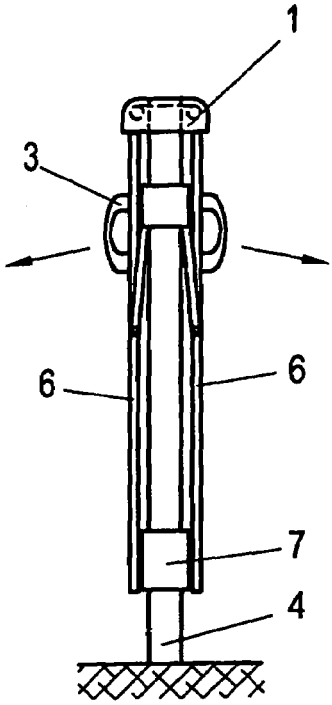
FIG. 3 is an elevational view of a laundry drying apparatus according to the invention with the open-out framework collapsed.
Figure 4:
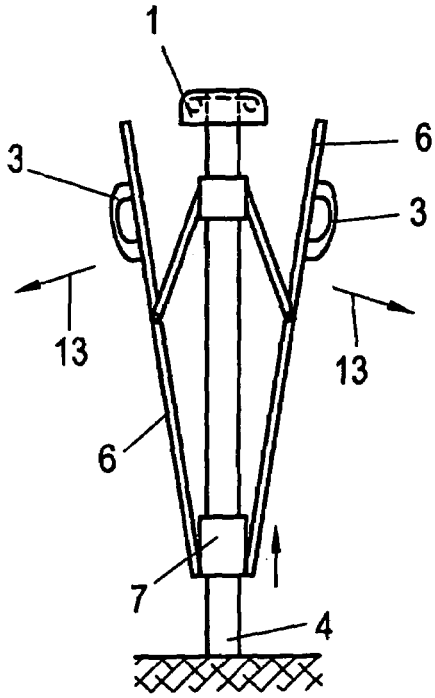
FIG. 4 is an elevational view of the apparatus of FIG. 3 in a partly swung-out open position.

Referring now to FIG. 3, the laundry drying apparatus according to the invention is provided with handgrips 3 in the top half of two carrying arms 6. The grips 3 are formed such that, when the protective sheath 1 is pulled downward, it can be pulled over the handgrips 3. In order for the open-out framework to be swung open, the handgrips 3 are pulled in the direction of the arrows 13, as is shown in FIGS. 3 and 4, and the lower sliding sleeve 7 is displaced upward on the upright tube 4.

Figure 5:
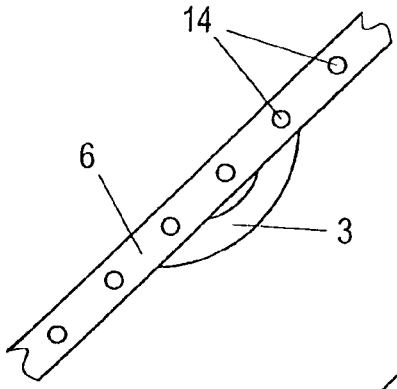
FIGS. 5 to 10 are partial perspective view illustrating different variants of an actuating handle of the apparatus according to the invention.
Figure 6:
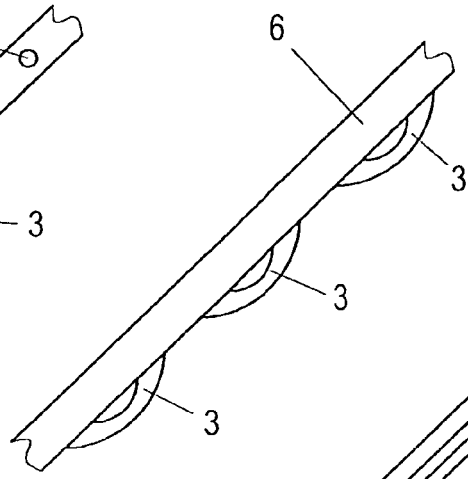
Figure 7:
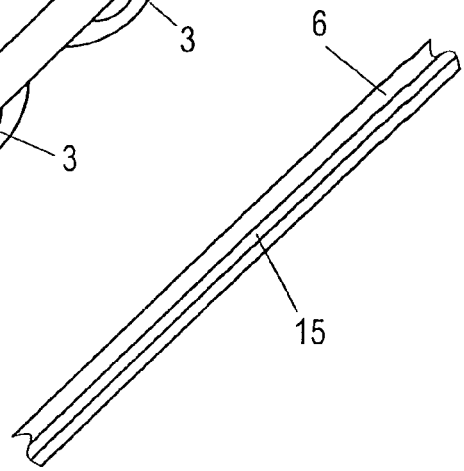
Figure 8:
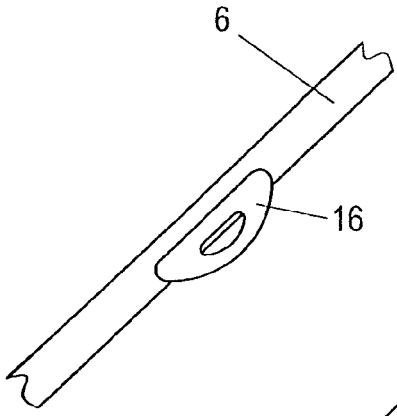
Figure 9:
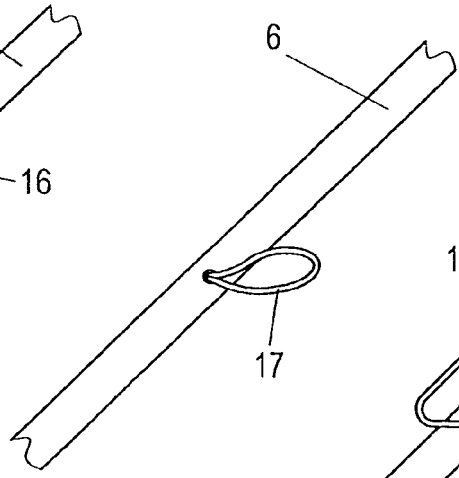
Figure 10:
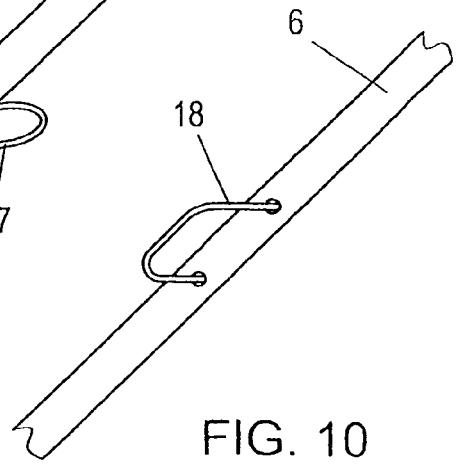

FIG. 5 illustrates a single handgrip 3 which is flattened at both ends in the direction of the carrying arm 6 in order to allow the protective sheath to be pulled over and removed without obstruction. Numeral 14 indicates openings through which the clothesline runs. In the variant which is shown in FIG. 6 a plurality of handles 3 are arranged at different heights. FIG. 7 shows a carrying arm 6 with a longitudinal profiling 15 serving as a handle. FIG. 8 shows a laterally arranged handgrip 16. FIGS. 9 and 10 show grip loops 17 and 18 as handles, wherein case, in FIG. 9, the ends of the grip loop 17 are fastened at one point on the carrying arm 6 and, in FIG. 10, the ends of the grip loop 18 are fastened at a distance from one another on the carrying arm 6.

This application claims the priority, under 35 U.S.C. § 119, of Austrian patent application No. A 1306/2003 filed Aug. 19, 2003 and of Austrian patent application No. A 1365/2003 filed Aug. 29, 2003; the disclosures of the prior applications are herewith incorporated by reference in their entirety.

I claim:

1. An umbrella-type laundry drying apparatus, comprising:

a central upright tube;

an open-out framework supported on said upright tube and being movable between a swung-open position and a collapsed position;

a substantially tubular protective sheath for covering said open-out framework in the collapsed position;

a lower sliding sleeve displaceably mounted along said upright tube and an upper sliding sleeve supported on said upright tube;

said open-out framework including carrying arms articulated to said lower sliding sleeve, clothesline supported on said carrying arms, and supporting arms articulated on said carrying arms and on said upper sliding sleeve;

an actuating mechanism for swinging open said open-out framework into the swung-open position, said actuating mechanism being formed by two of said carrying arms each bearing a handle formed to be covered by said protective sheath when said protective sheath is disposed to cover said open-out framework in the collapsed position thereof.

2. The laundry drying apparatus according to claim 1, wherein said carrying arms are disposed in a star shape when in the swung-open position and said lower sliding sleeve is mounted to be secured in different positions along said upright tube.

3. The laundry drying apparatus according to claim 1, wherein said handles are integrally formed on said carrying arms.

4. The laundry drying apparatus according to claim 1, wherein said handles are gripping protrusions of said carrying arms.

5. The laundry drying apparatus according to claim 4, wherein said gripping protrusions are disposed on an upper half of said carrying arms.

6. The laundry drying apparatus according to claim 4, wherein said gripping protrusions extend over substantially an entire length of said carrying arms.

7. The laundry drying apparatus according to claim 1, wherein said carrying arms are formed with a lateral longitudinal profiling forming said handle.

8. The laundry drying apparatus according to claim 7, wherein said handle-forming lateral longitudinal profiling extends over substantially an entire length of said carrying arm.

9. The laundry drying apparatus according to claim 1, wherein said handles are integrated in a profile cross section of said carrying arms.

10. The laundry drying apparatus according to claim 1, wherein each said handle is disposed on an outside of a respective said carrying arm distally from said upright tube.

11. The laundry drying apparatus according to claim 10, wherein each said handle is flattened in a direction towards a respective said carrying arm at least at a top end thereof.

12. The laundry drying apparatus according to claim 1, wherein each said handle is a movable grip loop.

13. The laundry drying apparatus according to claim 1, wherein each said handle is a grip loop disposed to be extended away from said carrying arm and to be pressed flat in a direction towards said carrying arm.

14. The laundry drying apparatus according to claim 1, wherein each said handle is a handgrip projecting laterally from said carrying arm and projecting into a free space between adjacent said carrying arms when said open-out framework is in the collapsed position.

15. The laundry drying apparatus according to claim 1, wherein each said handle is a swing-out handgrip articulated on a respective said carrying arm.

* * * * *